United States Patent [19]

Sieg et al.

[11] Patent Number: 4,722,783

[45] Date of Patent: Feb. 2, 1988

[54] CONDITIONING OF RECYCLE SHALE IN RETORTING PROCESS

[75] Inventors: Robert P. Sieg, Walnut Creek; P. Henrik Wallman, Berkeley; James R. Ouimette, Petaluma, all of Calif.

[73] Assignee: Chevron Research Company, San Francisco, Calif.

[21] Appl. No.: 506,760

[22] Filed: Jun. 22, 1983

[51] Int. Cl.[4] ..... C10G 1/00

[52] U.S. Cl. ..... 208/411; 208/410; 208/434

[58] Field of Search ..... 208/11 R, 410, 411, 208/434

[56] References Cited

U.S. PATENT DOCUMENTS

| | | | |
|---|---|---|---|
| 3,018,243 | 1/1962 | Nevens | 208/11 |
| 3,034,979 | 5/1962 | Nevens | 208/11 R |
| 3,703,442 | 11/1972 | Rammler et al. | 208/11 R X |
| 3,954,597 | 5/1976 | Morrell | 208/11 |
| 4,080,285 | 3/1978 | McKinney et al. | 208/11 R X |
| 4,105,502 | 8/1978 | Choi | 208/11 R X |
| 4,113,602 | 9/1978 | Gorbaty et al. | 208/8 |
| 4,157,245 | 6/1979 | Mitchell et al. | 48/197 R |
| 4,199,432 | 4/1980 | Tamm et al. | 208/8 |
| 4,219,402 | 8/1980 | DeGeorge | 208/8 |
| 4,246,093 | 1/1981 | Wolcott, Jr. | 208/11 R X |
| 4,289,603 | 9/1981 | DeGeorge | 208/8 |
| 4,312,740 | 1/1982 | Chiaramonte | 208/11 R |
| 4,320,795 | 3/1982 | Gwyn et al. | 165/1 |

*Primary Examiner*—Andrew H. Metz
*Assistant Examiner*—Glenn Caldarola
*Attorney, Agent, or Firm*—S. R. LaPaglia; T. G. DeJonghe; Q. T. Dickinson

[57] ABSTRACT

Burned oil shale recycled as heat transfer solids in retorting process conditioned under reducing conditions with hydrocarbon to improve product yield.

8 Claims, 3 Drawing Figures

CONDITIONING OF RECYCLE SHALE IN RETORTING PROCESS

BACKGROUND OF THE INVENTION

Oil shale is a naturally-occurring, shale-like rock which contains an organic component, usually referred to as kerogen, that upon heating releases volatile hydrocarbons recoverable as shale oil. Following pyrolysis of the kerogen, a residual carbonaceous material remains along with the mineral component that may be burned to yield heat for the pyrolysis of fresh oil shale. The hot mineral residue that remains after combustion of the carbonaceous component is recycled in some retorting schemes as "heat transfer material", i.e., the hot burned shale from the combustion is mixed with fresh oil shale and the heat provided is used for pyrolyzing the fresh shale. Although retorting schemes using recycled shale as heat transfer material have significant advantages over other retorting systems, the burned oil shale is not an ideal material for this purpose.

During pyrolysis of the kerogen and combustion of the remaining carbonaceous residue, the inorganic matrix undergoes both chemical and physical changes. It has been observed that the use of recycled burned oil shale particles as heat transfer solids can lead to significant yield reductions of the shale oil product. These losses, in some instances, can run as high as 15% to 20% Controlling these losses would be important in any commercial scheme for recovering shale oil.

SUMMARY OF THE INVENTION

The present invention is directed toward an improved process for retorting a particulate oil shale including the steps of (a) recovering pyrolyzed oil shale containing a carbonaceous residue from a retorting zone; (b) burning the carbonaceous residue in the pyrolyzed oil shale in a combustion zone to heat said burned and pyrolyzed oil shale to a temperature of at least 1000° F.; and (c) recycling the hot burned and pyrolyzed oil shale to the retorting zone to serve as a heat transfer solid for heating fresh oil shale to a pyrolyzing temperature; the improvement comprising a process for conditioning the burned and pyrolyzed oil shale prior to being recycled to the retorting zone by contacting the burned oil shale at a temperature of from about 900° F. to about 1500° F. with a hydrocarbon under reducing conditions for a time sufficient to deposit at least 0.1% coke on the recycle. As will be explained in greater detail below, it has been found that the amount of coke deposited on the recycled burned shale will directly affect the yield of shale oil from the retorting zone. In addition, shale oil yield may be decreased by the presence of non-organic oxidizing compounds in the recycle. Under the reducing conditions used in carrying out the conditioning step, these oxidizing compounds are reduced. For example, iron oxide is such a compound. Ferric oxide in the recycle will oxidize the hydrocarbons released from the kerogen to decrease the yield of product oil and gas. Upon treatment of the recycle shale according to the present invention the ferric oxide is converted to ferrous oxide which does not oxidize the product hydrocarbons.

DETAILED DESCRIPTION OF THE INVENTION

Figure 1:
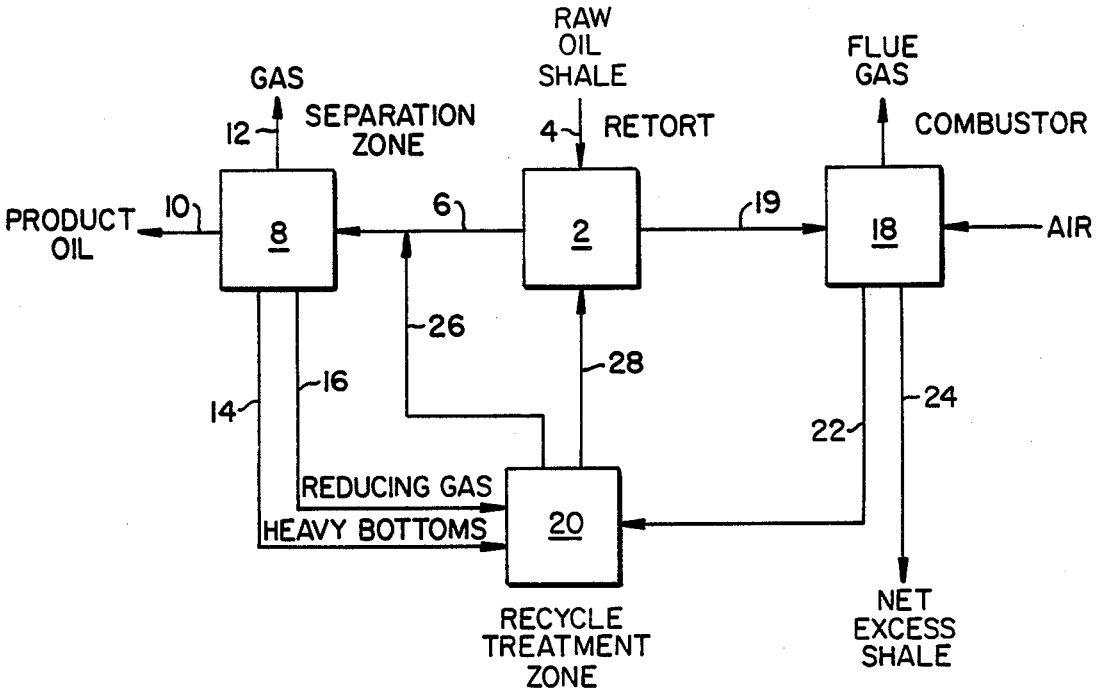
FIG. 1 is a schematic representation of a process for recovering shale oil from oil shale embodying the recycle treatment step that is the subject of this invention.

The invention may be more clearly understood by referring to the drawing which illustrates schematically a process for recovering shale oil from oil shale. In the diagram particulate raw oil shale enters the retort 2 via feed conduit 4. In the retort the raw oil shale is heated to a temperature suitable to pyrolyze the kerogen by mixing the raw feed with hot recycled shale which serves as a heat transfer solid. The product vapors are recovered from the retort by conduit 6 and sent to a separation zone 8. In the separation zone the product oil is recovered via line 10 separately from non-condensible gas leaving by exhaust 12. In addition, in the scheme shown a high boiling bottoms fraction is recovered separately via 14. Part of the light hydrocarbons including hydrogen, hydrogen sulfide, and/or ammonia released in the separation zone are withdrawn separately via line 16 for use in treating the recycle.

Returning to the retort 2, the mineral component of the pyrolyzed oil shale left in the retort after decomposition of the kerogen still contains a carbonaceous component. The pyrolyzed residue is carried from the retort to the combustor 18 via conduit 19. In the combustor the carbonaceous component is burned in the presence of air to raise the temperature of the mineral residue to at least 1000° F., but more preferably, to at least 1200° F. Hot mineral solids intended for recycle to the retort are sent to the recycle treatment zone 20 via conduit 22. Excess solids are withdrawn from the system by line 24.

In the recycle treatment zone the hot mineral residue is contacted with the bottoms fraction entering from the separation zone 8 via line 14. Under the reducing conditions prevailing in the recycle treatment zone, the heavy bottoms fraction will deposit coke on the particulate mineral residue. In addition, oxidizing compounds on the surface of the mineral residue will be reduced. The presence of the light hydrocarbons including hydrogen, hydrogen sulfide, and possibly ammonia entering via 16, aid in maintaining the reducing environment and are important in reducing the oxidizing compounds in the mineral residue. Cracked hydrocarbon vapors and other gases from the recycle treatment zone are returned to the separation zone 8 by conduit 26. The conditioned mineral residue is returned to the retort 2 for use as heat transfer solids by recycle line 28.

Figure 2:
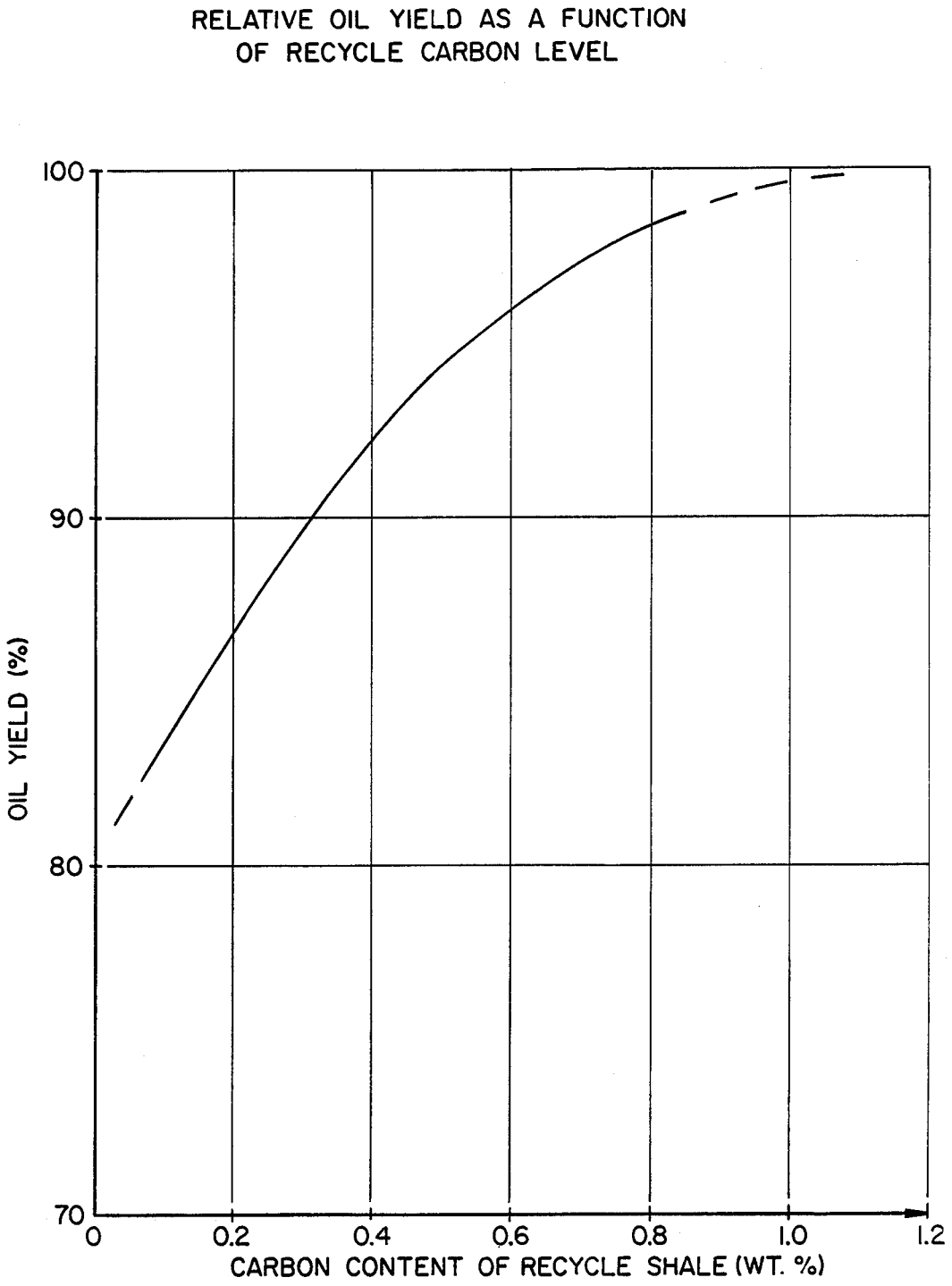
FIG. 2 illustrates graphically the relationship between residual carbon in the recycle and product yield.

As noted above the pyrolyzed oil shale recovered from the retorting zone contains a carbonaceous component that is burned to provide heat. To provide maximum heat efficiency, it is desirable to burn this carbon component as completely as possible. However, it has been found that the presence of carbon in the mineral residue is important to prevent product losses. This is illustrated by the graph in FIG. 2 which shows relative oil yield plotted against the unburned carbon residue remaining in the shale recycled to the retort. This graph clearly shows a relationship between yield loss and carbon content of the recycle.

In the process that is the subject of the invention, at least 0.1 weight percent coke is deposited on the recycle. Preferably, at least 0.3% coke is deposited on the recycle prior to return to the retort. The hydrocarbon used to contact the recycle shale is preferably a heavy bottoms fraction recovered from the shale oil itself. But other hydrocarbons such as recycle product gas, natural gas, etc., may also be employed. As used herein, the term "heavy fraction" refers to a fraction with 90% boiling above 850° F.

Figure 3:
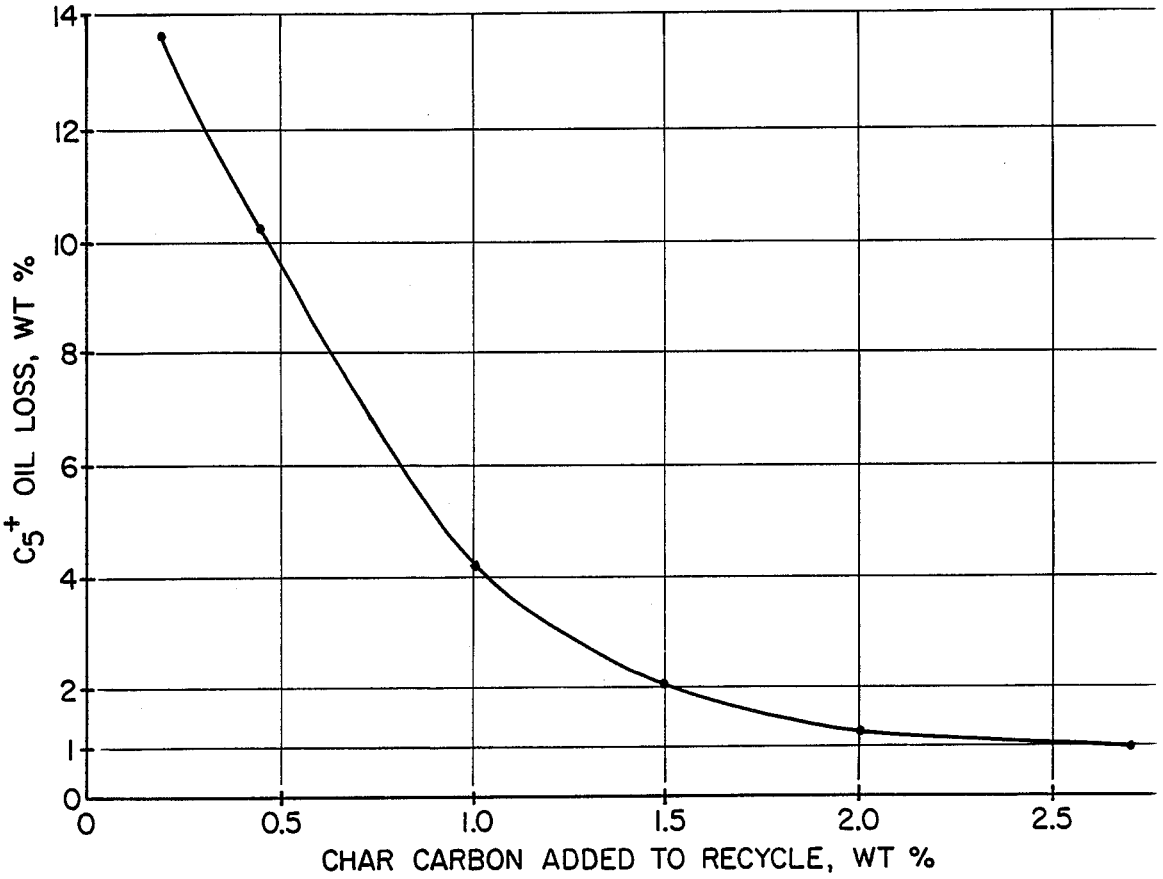
FIG. 3 is a graph showing the improvement in shale oil yield resulting from conditioning of the recycle shale prior to return to the retort.

FIG. 3 illustrates graphically the improvement in oil yield that results with increases in coke deposition during the conditioning step.

In carrying out the invention, it is desirable that a reducing gas, such as light hydrocarbons including hydrogen and hydrogen sulfide formed during retorting, be introduced into the recycle treatment zone. Other reducing materials such as natural gas may also be added to the conditioning step. These materials aid in the reduction of the oxidizing compounds present on the surface of the mineral residue. If left unaltered, the oxidizing compounds will reduce product yields by oxidizing the hydrocarbons released by the kerogen in the retort. One skilled in the art will recognize that the reduction of the oxidizing compounds and the coke deposition may be carried out in separate steps, but for convenience, the two conditioning steps preferably are carried out together.

The present invention is most advantageously used in conditioning recycle shale derived from oil shales having a mineral matrix made up primarily of carbonates such as the shale found in the Green River formation of the Western United States. However, the present process may also be used for conditioning recycle material derived from other types of oil shales such as those having a silicaceous matrix.

What is claimed is:

1. In a process for retorting a particulate oil shale, which process includes the steps of:

(a) recovering pyrolyzed shale containing a carbonaceous residue from a retorting zone;

(b) burning the carbonaceous residue from the pyrolyzed shale in a combustion zone to heat the thus-produced burned shale to a temperature of at least 1000° F.; and (c) recycling the burned shale to the retorting zone to serve as a heat-transfer solid for heating fresh oil shale to a pyrolyzing temperature; the improvement which comprises:

(c1) conditioning the burned shale produced in step (b) by contacting the burned shale with a hydrocarbon under reducing conditions at a temperature between about 900° F. and about 1500° F. for a time sufficient to deposit at least 0.1% by weight of coke on the burned shale; and (c2) recycling the coked burned shale to the retorting zone to serve as a heat-transfer solid.

2. The process of claim 1 wherein at least 0.3% by weight of coke is deposited on the burned shale in conditioning step (c1).

3. The process of claim 1 wherein the hydrocarbon is a shale oil heavy fraction.

4. The process of claim 1 wherein the burned shale is contacted in conditioning step (c1) with a conditioning agent selected from the group consisting of light hydrocarbons, hydrogen, hydrogen sulfide, ammonia, and mixtures thereof.

5. The process of claim 1 wherein oxidizing compounds in the burned shale are reduced prior to recycling step (c2).

6. The process of claim 5 wherein the oxidizing compounds are reduced in conditioning step (c1).

7. In a process for retorting a particular oil shale, which process includes the step of:

(a) recovering pyrolyzed shale containing a carbonaceous residue from a retorting zone;

(b) burning the carbonaceous residue from the pyrolyzed shale in a combustion zone to heat the thus-produced burned shale to a temperature of at least 1000° F.; and (c) recycling the burned shale to the restorting zone to serve as a heat-transfer solid for heating fresh oil shale to a pyrolyzing temperature; the improvement which comprises:

(c1) conditioning the burned shale produced in step (b) by contacting the burned shale with a reducing gas at a temperature between about 900° F. and about 1500° F. for a time sufficient to reduce oxidizing compounds in the burned shale; and (c2) recycling the conditioned burned shale to the retorting zone to serve as a heat-transfer solid.

8. The process of claim 7 wherein the reducing gas comprises light hydrocarbons, hydrogen, hydrogen sulfide, or mixtures thereof.

* * * * *